US010190078B2

(12) United States Patent
Hulskotter et al.

(10) Patent No.: US 10,190,078 B2
(45) **Date of Patent: *Jan. 29, 2019**

(54) DETERGENT

(71) Applicant: The Procter & Gamble Company, Cincinnati, OH (US)

(72) Inventors: Frank Hulskotter, Bad Durkheim (DE); Patrick Firmin August Delplancke, Steenhuize-Wijnhuize (BE); Glen Steven Ward, Newcastle upon Tyne (GB); Anna Asmanidou, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 543 days.

This patent is subject to a terminal disclaimer.

(21) Appl. No.: 14/700,303

(22) Filed: Apr. 30, 2015

(65) Prior Publication Data

US 2015/0315523 A1 Nov. 5, 2015

(30) Foreign Application Priority Data

Apr. 30, 2014 (EP) ..... 14166717

(51) Int. Cl.

| | |
|---|---|
| ***C11D 3/00*** | (2006.01) |
| ***C11D 3/30*** | (2006.01) |
| ***C11D 3/386*** | (2006.01) |
| ***C11D 3/33*** | (2006.01) |
| ***C11D 1/14*** | (2006.01) |
| ***C11D 1/22*** | (2006.01) |
| ***C11D 1/29*** | (2006.01) |
| ***C11D 3/37*** | (2006.01) |

(52) U.S. Cl.

CPC ..... *C11D 3/30* (2013.01); *C11D 1/143* (2013.01); *C11D 1/146* (2013.01); *C11D 1/22* (2013.01); *C11D 1/29* (2013.01); *C11D 3/0026* (2013.01); *C11D 3/33* (2013.01); *C11D 3/3707* (2013.01); *C11D 3/3723* (2013.01); *C11D 3/386* (2013.01)

(58) Field of Classification Search

CPC ..... C11D 3/30; C11D 3/00

See application file for complete search history.

(56) References Cited

U.S. PATENT DOCUMENTS

| | | | | |
|---|---|---|---|---|
| 5,468,423 | A | 11/1995 | Garabedian et al. | |
| 5,827,813 | A * | 10/1998 | Hartman | C11D 1/40 510/443 |
| 6,069,122 | A * | 5/2000 | Vinson | C11D 3/0094 510/235 |
| 6,362,147 | B1 | 3/2002 | Castro et al. | |
| 6,372,708 | B1 * | 4/2002 | Kasturi | C11D 3/0094 510/475 |
| 6,593,287 | B1 * | 7/2003 | Jordan, IV | A61K 8/39 510/221 |
| 6,710,023 | B1 * | 3/2004 | Bodet | C11D 1/83 510/235 |
| 6,774,099 | B1 * | 8/2004 | Scheibel | C11D 1/83 510/357 |
| 8,012,267 | B2 | 9/2011 | Jekel et al. | |
| 9,193,939 | B2 * | 11/2015 | Hulskotter | C11D 3/0036 |
| 9,540,592 | B2 * | 1/2017 | Hulskotter | C11D 3/0036 |
| 9,550,965 | B2 * | 1/2017 | Hulskotter | C11D 3/30 |
| 9,637,710 | B2 * | 5/2017 | Hulskotter | C11D 3/3707 |
| 2011/0061174 | A1 * | 3/2011 | Boutique | C11D 1/83 8/137 |
| 2013/0150276 | A1 * | 6/2013 | Dicapua | C11D 3/3788 510/219 |
| 2013/0225837 | A1 * | 8/2013 | Iinuma | C07C 217/08 548/568 |
| 2015/0315523 | A1 * | 11/2015 | Hulskotter | C11D 3/386 510/226 |
| 2016/0052867 | A1 | 2/2016 | Ebert et al. | |
| 2016/0251304 | A1 | 9/2016 | Ebert et al. | |

FOREIGN PATENT DOCUMENTS

| | | | |
|---|---|---|---|
| EP | 1 518 922 | A1 | 3/2005 |
| EP | 2 280 058 | A1 | 2/2011 |
| JP | 2905913 | B2 * | 6/1999 |
| JP | 2004-506750 | A | 3/2004 |
| JP | 2005-97496 | A | 4/2005 |
| JP | 2005-171173 | A | 6/2005 |
| JP | 2007-16131 | A | 1/2007 |
| JP | 2012-140573 | A | 7/2012 |
| WO | WO9924539 | A1 | 5/1999 |
| WO | WO 01/76729 | A2 | 10/2001 |
| WO | WO 02/08371 | A2 | 1/2002 |

OTHER PUBLICATIONS

JP 2905913. Kondo et al. English Translation.*

EPO Search Report 14166717.0-1358; dated Jan. 5, 2015; 6 Pages.

* cited by examiner

*Primary Examiner* — Nicole M. Buie-Hatcher

*Assistant Examiner* — M. Reza Asdjodi

(74) *Attorney, Agent, or Firm* — Lauren Christine Gonzalez

(57) ABSTRACT

An automatic dishwashing detergent composition comprising:

a) from about 0.1% to about 20% by weight of a cleaning surfactant selected from the group consisting of an anionic surfactant, a zwitterionic surfactant, an amphoteric surfactant, and mixtures thereof;

b) from about 0.1% to about 20% by weight of a cleaning amine.

10 Claims, No Drawings

DETERGENT

FIELD OF THE INVENTION

The present invention is in the field of detergents. In particular, it relates to an automatic dishwashing detergent composition, more in particular to an automatic dishwashing detergent composition comprising a cleaning amine. The composition provides good cooked-, baked- and burnt-on soil removal.

BACKGROUND OF THE INVENTION

Cooked-, baked- and burnt-on soils are amongst the most severe types of soils to remove from surfaces. Traditionally, the removal of cooked-, baked- and burnt-on soils from cookware and tableware requires soaking the soiled object prior to mechanical action. Apparently, the automatic dishwashing process alone does not provide a satisfactory removal of cooked-, baked- and burnt-on soils.

The removal of good cooked-, baked- and burnt-on soil is even more challenging when using a phosphate free detergent.

The objective of the present invention is to provide an automatic dishwashing detergent composition capable to provide tough food removal, including cooked-, baked- and burnt-on soils.

SUMMARY OF THE INVENTION

According to a first aspect of the invention, there is provided an automatic dishwashing detergent composition. The composition comprises a cleaning surfactant and a cleaning amine. The surfactant is selected from the group consisting of an anionic surfactant, a zwitterionic surfactant, an amphoteric surfactant, and mixtures thereof.

Traditionally, the only surfactants used in automatic dishwashing compositions are low foaming non-ionic surfactants. These surfactants help with sheeting of the water and contribute to the lack of filming and/or spotting that it is then reflected in better shine of the washed items. The present invention requires the presence of different types of surfactants for a different benefit. In the course of this work, it has been found out that the cleaning surfactants act synergistically in combination with the cleaning amines to provide though food soil removal.

By "cleaning surfactant" is herein understood a surfactant that contributes to cleaning in the composition of the invention, as opposite to only prevent filming and spotting.

By "cleaning amine" is herein meant a molecule, having one of the formulas depicted herein below, comprising amine functionalities that helps cleaning as part of a cleaning composition.

The term "cleaning amine" herein encompasses a single cleaning amine and a mixture thereof.

The amine can be subjected to protonation depending on the pH of the cleaning medium in which it is used. The use of quaternized amines is envisaged in the present invention although it is not preferred.

Amines sometimes are used as solvents in detergent compositions. In the present invention the amines play an active role in the cleaning of tough food soils.

Preferred cleaning surfactants for use herein are anionic surfactants, in particular anionic surfactant selected from the group consisting of sulfonate, sulfate, carboxylate and mixtures thereof, have been found to provide very good tough food cleaning removal.

Preferred cleaning amines for use herein are cyclic amine of the following formula:

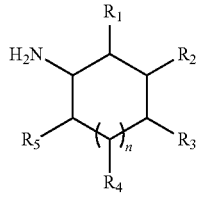

wherein the radicals $R_1$, $R_2$, $R_3$, $R_4$ and $R_5$ are independently selected from NH2, —H, linear or branched alkyl or alkenyl having from 1 to 10 carbon atoms and n is from 0 to 3 and wherein at least one of the radicals is NH2.

Also preferred cleaning amines for use herein are polyetheramines selected from the group consisting of polyetheramines of Formula (I), Formula (II), Formula (III) and a mixture thereof:

Formula (I)

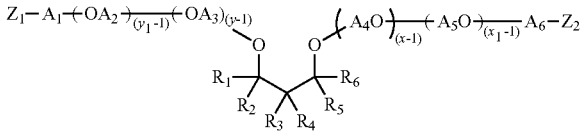

Formula (II)

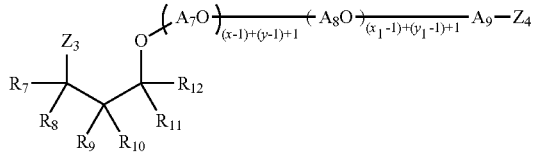

wherein each of $R_1$-$R_{12}$ is independently selected from H, alkyl, cycloalkyl, aryl, alkylaryl, or arylalkyl, wherein at least one of $R_1$-$R_6$ and at least one of $R_7$-$R_{12}$ is different from H, each of $A_1$-$A_9$ is independently selected from linear or branched alkylenes having 2 to 18 carbon atoms, each of $Z_1$-$Z_4$ is independently selected from OH or $NH_2$, wherein at least one of $Z_1$-$Z_2$ and at least one of $Z_3$-$Z_4$ is $NH_2$, wherein the sum of x+y is in the range of about 2 to about 200, wherein x≥1 and y≥1, and the sum of $x_1+y_1$ is in the range of about 2 to about 200, wherein $x_1 \geq 1$ and $y_1 \geq 1$.

Formula (III)

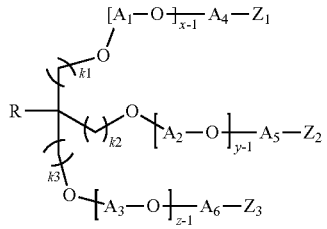

wherein

R is selected from H or a C1-C6 alkyl group, each of $k_1$, $k_2$, and $k_3$ is independently selected from 0, 1, 2, 3, 4, 5, or 6, each of $A_1$, $A_2$, $A_3$, $A_4$, $A_5$, and $A_6$ is independently selected from a linear or branched alkylene group having from about 2 to about 18 carbon atoms or mixtures thereof, x≥1, y≥1, and z≥1, and the sum of x+y+z is in the range of from about 3 to about 100, each of $Z_1$, $Z_2$, and $Z_3$ is independently selected from $NH_2$ or OH, where at least two of $Z_1$, $Z_2$, and $Z_3$ are $NH_2$; and the polyetheramine has a weight average molecular weight of from about 150 to about 1000 grams/mole.

Other preferred amines for use herein are amines of Formula (1):

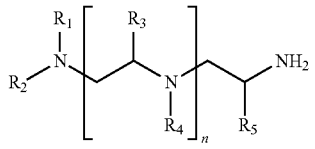

wherein: $R_1$, $R_2$, $R_3$, $R_4$, and $R_5$ are independently selected from —H, linear, branched or cyclic alkyl or alkenyl having from 1 to 10 carbon atoms and n=0-3.

or Formula (2):

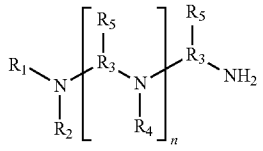

wherein $R_1$ and $R_4$ are independently selected from —H, linear, branched or cyclic alkyl or alkenyl; and $R_2$ is a linear, branched or cyclic alkyl or alkenyl having from 3 to 10 carbons, $R_3$ is a linear or branched alkyl from 3 to 6 carbon atoms, $R_5$ is H, methyl or ethyl and n=0-3.

The compositions of the invention can comprise a phosphate builder but are preferably free of phosphate. Preferably, the composition of the invention further comprises an aminocarboxylic builder.

The compositions of the present invention can comprise a non-ionic surfactant. However, compositions free of non-ionic surfactants, i.e. comprising less than 1%, more preferably less than 0.5% and especially less than 1% of non-ionic surfactant, have been found to provide not only good cleaning but also good shine.

There is also provided a method of removing cooked-on, baked-on and burnt-on soils from cookware/tableware in automatic dishwashing, using the composition of the invention.

SUMMARY OF THE INVENTION

According to a first aspect of the invention, there is provided an automatic dishwashing detergent composition comprising a cleaning surfactant and a cleaning amine. The composition provides good removal of tough food soils (cooked-on, baked-on, burnt-on soils). There is also provided a method of automatic dishwashing using the composition of the invention and the use of the composition to provide cooked-on, baked-on, burnt-on soil removal.

Cleaning Surfactant

The detergent composition comprises from about 0.1% to about 20%, preferably from about 0.5% to about 15% more preferably from about 1% to about 10% by weight of the composition of a cleaning surfactant. The preferred cleaning surfactant for use herein is an anionic surfactant. LAS (C11-C18 alkyl benzene sulphonate) being specially preferred for use herein. Alkyl alkoxylated surfactant, in particular alkyl alkoxylated surfactant are also preferred for use herein.

Anionic Surfactant

Anionic surfactants include, but are not limited to, those surface-active compounds that contain an organic hydrophobic group containing generally 8 to 22 carbon atoms or generally 8 to 18 carbon atoms in their molecular structure and at least one water-solubilizing group preferably selected from sulfonate, sulfate, and carboxylate so as to form a water-soluble compound. Usually, the hydrophobic group will comprise a C 8-C 22 alkyl, or acyl group. Such surfactants are employed in the form of water-soluble salts and the salt-forming cation usually is selected from sodium, potassium, ammonium, magnesium and mono-, di- or tri-C 2-C 3 alkanolammonium, with the sodium, cation being the usual one chosen.

Sulfate Surfactant

Suitable sulfate surfactants for use herein include water-soluble salts of C8-C18 alkyl or hydroxyalkyl, sulfate and/or ether sulfate. Suitable counterions include alkali metal cation or ammonium or substituted ammonium, but preferably sodium.

The sulfate surfactants may be selected from C8-C18 primary, branched chain and random alkyl sulfates (AS); C8-C18 secondary (2,3) alkyl sulfates; C8-C18 alkyl alkoxy sulfates (AExS) wherein preferably x is from 1-30 in which the alkoxy group could be selected from ethoxy, propoxy, butoxy or even higher alkoxy groups and mixtures thereof.

Alkyl sulfates and alkyl alkoxy sulfates are commercially available with a variety of chain lengths, ethoxylation and branching degrees. Commercially available sulfates include, those based on Neodol alcohols ex the Shell company, Lial-Isalchem and Safol ex the Sasol company, natural alcohols ex The Procter & Gamble Chemicals company.

Sulphonate Surfactant

Suitable sulphonate surfactants for use herein include water-soluble salts of C8-C18 alkyl or hydroxyalkyl sulphonates; C11-C18 alkyl benzene sulphonates (LAS), modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulphonate (MES); and alpha-olefin sulphonate (AOS). Those also include the paraffin sulphonates may be monosulphonates and/or disulphonates, obtained by sulphonating paraffins of 10 to 20 carbon atoms. The sulfonate surfactant also include the alkyl glyceryl sulphonate surfactants.

Especially preferred for use herein are C10-C15 alkyl benzene sulfonates (LAS)

Carboxylate Surfactant

Suitable carboxylate surfactant for use herein includes alkyl carboxylate and alkyl ether carboxylate.

Preferred alkyl carboxylate includes fatty acids and mixtures thereof. For example, oleic acid, rapeseed acid and mixtures thereof.

Especially suitable alkyl ether carboxylate for use herein has been found to be carboxylate with a saturated, linear or branched chain of about 8 carbon atoms or equal to greater than 16 carbon atoms. Furthermore a low degree of ethoxylation is preferred. These carboxylates are good for cleaning and show low sudsing that favours automatic dishwashing cleaning.

Amphoteric Surfactant

Preferred amine oxides are alkyl dimethyl amine oxide or alkyl amido propyl dimethyl amine oxide, more preferably alkyl dimethyl amine oxide and especially coco dimethyl amino oxide. Amine oxide may have a linear or mid-branched alkyl moiety. Typical linear amine oxides include water-soluble amine oxides containing one R1 C8-18 alkyl moiety and 2 R2 and R3 moieties selected from the group consisting of C1-3 alkyl groups and C1-3 hydroxyalkyl groups. Preferably amine oxide is characterized by the formula R1-N(R2)(R3) 0 wherein R1 is a C8-18 alkyl and R2 and R3 are selected from the group consisting of methyl, ethyl, propyl, isopropyl, 2-hydroxethyl, 2-hydroxypropyl and 3-hydroxypropyl. The linear amine oxide surfactants in particular may include linear C10-C18 alkyl dimethyl amine oxides and linear C8-C12 alkoxy ethyl dihydroxy ethyl amine oxides. Preferred amine oxides include linear C10, linear C10-C12, and linear C12-C14 alkyl dimethyl amine oxides. As used herein "mid-branched" means that the amine oxide has one alkyl moiety having n1 carbon atoms with one alkyl branch on the alkyl moiety having n2 carbon atoms. The alkyl branch is located on the a carbon from the nitrogen on the alkyl moiety. This type of branching for the amine oxide is also known in the art as an internal amine oxide. The total sum of n1 and n2 is from 10 to 24 carbon atoms, preferably from 12 to 20, and more preferably from 10 to 16. The number of carbon atoms for the one alkyl moiety (n1) should be approximately the same number of carbon atoms as the one alkyl branch (n2) such that the one alkyl moiety and the one alkyl branch are symmetric. As used herein "symmetric" means that |n1−n2| is less than or equal to 5, preferably 4, most preferably from 0 to 4 carbon atoms in at least 50 wt %, more preferably at least 75 wt % to 100 wt % of the mid-branched amine oxides for use herein.

The amine oxide further comprises two moieties, independently selected from a C1-3 alkyl, a C1-3 hydroxyalkyl group, or a polyethylene oxide group containing an average of from about 1 to about 3 ethylene oxide groups. Preferably the two moieties are selected from a C1-3 alkyl, more preferably both are selected as a C1 alkyl.

Zwitterionic Surfactant

Other suitable surfactants include betaines, such as alkyl betaines, alkylamidobetaine, amidazoliniumbetaine, sulfobetaine (INCI Sultaines) as well as the Phosphobetaine and preferably meets formula I:

R1-[CO—X(CH2)*n*]*x*-N—F(R2)(R3)-(CH2)*m*-[CH(OH)—CH2]*y*-Y— (I)

wherein

R1 is a saturated or unsaturated C6-22 alkyl residue, preferably C8-18 alkyl residue, in particular a saturated C10-16 alkyl residue, for example a saturated C12-14 alkyl residue;

X is NH, NR4 with C1-4 Alkyl residue R4, 0 or S, n a number from 1 to 10, preferably 2 to 5, in particular 3, x 0 or 1, preferably 1, R2, R3 are independently a C1-4 alkyl residue, potentially hydroxy substituted such as a hydroxyethyl, preferably a methyl.

m a number from 1 to 4, in particular 1, 2 or 3, y 0 or 1 and

Y is COO, SO3, OPO(OR5)O or P(O)(OR5)O, whereby R5 is a hydrogen atom H or a C1-4 alkyl residue.

Preferred betaines are the alkyl betaines of the formula (Ia), the alkyl amido propyl betaine of the formula (Ib), the Sulfo betaines of the formula (Ic) and the Amido sulfobetaine of the formula (Id);

R1-N+(CH3)2-CH2COO— (Ia)

R1-CO—NH(CH2)3-N+(CH3)2-CH2COO— (Ib)

R1-N+(CH3)2-CH2CH(OH)CH2SO3- (Ic)

R1-CO—NH—(CH2)3-N+(CH3)2-CH2CH(OH)CH2SO3- (Id) in which R11 as the same meaning as in formula I. Particularly preferred betaines are the Carbobetaine [wherein Y—═COO—], in particular the Carbobetaine of the formula (Ia) and (Ib), more preferred are the Alkylamidobetaine of the formula (Ib).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines.

A preferred betaine is, for example, Cocoamidopropylbetain.

Cleaning Amine

The composition described herein includes from about 0.1% to about 10%, preferably, from about 0.2% to about 5%, and more preferably, from about 0.5% to about 4%, by weight of the composition, of a cleaning amine.

A preferred cleaning amine for use herein is a cyclic amine conforming the following formula:

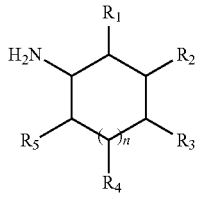

The substituents "Rs" can be independently selected from NH2, H and linear, branched alkyl or alkenyl from 1 to 10 carbon atoms. For the purpose of this invention "Rs" includes R1-R5. At least one of the "Rs" needs to be NH2. The remaining "Rs" can be independently selected from NH2, H and linear, branched alkyl or alkenyl from 1 to 10 carbon atoms. n is from 0 to 3, preferably 1.

The amine of the invention is a cyclic amine with at least two primary amine functionalities. The primary amines can be in any position in the cycle but it has been found that in terms of grease cleaning better performance is obtained when the primary amines are in positions 1,3. It has also been found advantageous in terms of grease cleaning amines in which one of the substituents is —CH3 and the rest are H.

The term "cleaning amine" herein encompasses a single cleaning amine and a mixture thereof. A "cleaning amine" herein means a molecule comprising amine functionalities that helps cleaning as part of a cleaning composition.

The amine can be subjected to protonation depending on the pH of the cleaning medium in which it is used.

Preferred cleaning amines include polyetheramines. One of the polyetheramine preferred for use in the composition of the invention is represented by the structure of Formula (I):

Formula (I)

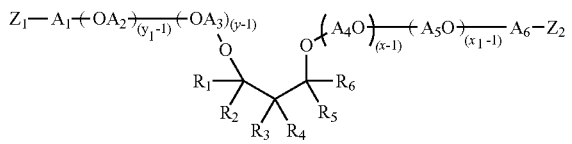

where each of $R_1$-$R_6$ is independently selected from H, alkyl, cycloalkyl, aryl, alkylaryl, or arylalkyl, where at least one of $R_1$-$R_6$ is different from H, typically at least one of $R_1$-$R_6$ is an alkyl group having 2 to 8 carbon atoms, each of $A_1$-$A_6$ is independently selected from linear or branched alkylenes having 2 to 18 carbon atoms, each of $Z_1$-$Z_2$ is independently selected from OH or $NH_2$, where at least one of $Z_1$-$Z_2$ is $NH_2$, typically each of $Z_1$ and $Z_2$ is $NH_2$, where the sum of x+y is in the range of about 2 to about 200, typically about 2 to about 20, more typically about 2 to about 10 or about 3 to about 8 or about 4 to about 6, where x≥1 and y≥1, and the sum of $x_1+y_1$ is in the range of about 2 to about 200, typically about 2 to about 20, more typically about 2 to about 10 or about 3 to about 8 or about 2 to about 4, where $x_1 \geq 1$ and $y_1 \geq 1$.

Preferably in the polyetheramine of Formula (I), each of $A_1$-$A_6$ is independently selected from ethylene, propylene, or butylene, typically each of $A_1$-$A_6$ is propylene. More preferably, in the polyetheramine of Formula (I), each of $R_1$, $R_2$, $R_5$, and $R_6$ is H and each of $R_3$ and $R_4$ is independently selected from C1-C16 alkyl or aryl, typically each of $R_1$, $R_2$, $R_5$, and $R_6$ is H and each of $R_3$ and $R_4$ is independently selected from a butyl group, an ethyl group, a methyl group, a propyl group, or a phenyl group. More preferably, in the polyetheramine of Formula (I), $R_3$ is an ethyl group, each of $R_1$, $R_2$, $R_5$, and $R_6$ is H, and $R_4$ is a butyl group. Especially, in the polyetheramine of Formula (I), each of $R_1$ and $R_2$ is H and each of $R_3$, $R_4$, $R_5$, and $R_6$ is independently selected from an ethyl group, a methyl group, a propyl group, a butyl group, a phenyl group, or H.

In the polyetheramine represented by the structure of Formula (II):

Formula (II)

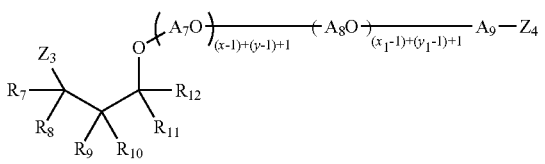

each of $R_7$-$R_{12}$ is independently selected from H, alkyl, cycloalkyl, aryl, alkylaryl, or arylalkyl, where at least one of $R_7$-$R_{12}$ is different from H, typically at least one of $R_7$-$R_{12}$ is an alkyl group having 2 to 8 carbon atoms, each of $A_7$-$A_9$ is independently selected from linear or branched alkylenes having 2 to 18 carbon atoms, each of $Z_3$-$Z_4$ is independently selected from OH or $NH_2$, where at least one of $Z_3$-$Z_4$ is $NH_2$, typically each of $Z_3$ and $Z_4$ is $NH_2$, where the sum of x+y is in the range of about 2 to about 200, typically about 2 to about 20, more typically about 2 to about 10 or about 3 to about 8 or about 2 to about 4, where x≥1 and y≥1, and the sum of $x_1+y_1$ is in the range of about 2 to about 200, typically about 2 to about 20, more typically about 2 to about 10 or about 3 to about 8 or about 2 to about 4, where $x_1 \geq 1$ and $y_1 \geq 1$.

Preferably in the polyetheramine of Formula (II), each of $A_7$-$A_9$ is independently selected from ethylene, propylene, or butylene, typically each of $A_7$-$A_9$ is propylene. More preferably, in the polyetheramine of Formula (II), each of $R_7$, $R_8$, $R_{11}$, and $R_{12}$ is H and each of $R_9$ and $R_{10}$ is independently selected from C1-C16 alkyl or aryl, typically each of $R_7$, $R_8$, $R_{11}$, and $R_{12}$ is H and each of $R_9$ and $R_{10}$ is independently selected from a butyl group, an ethyl group, a methyl group, a propyl group, or a phenyl group. More preferably, in the polyetheramine of Formula (II), $R_9$ is an ethyl group, each of $R_7$, $R_8$, $R_{11}$, and $R_{12}$ is H, and $R_{10}$ is a butyl group. In some aspects, in the polyetheramine of Formula (II), each of $R_7$ and $R_8$ is H and each of $R_9$, $R_{10}$, $R_{11}$, and $R_{12}$ is independently selected from an ethyl group, a methyl group, a propyl group, a butyl group, a phenyl group, or H.

Preferred polyetheramines are selected from the group consisting of Formula A, Formula B, and mixtures thereof:

Formula A

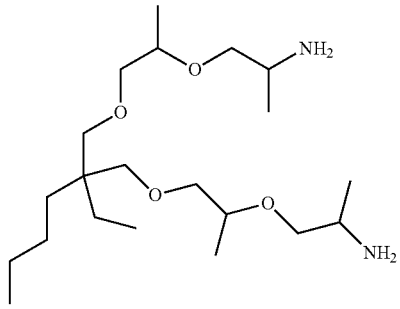

Formula B

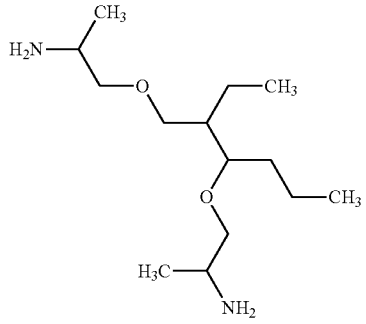

Preferably, the polyetheramine comprises a mixture of the compound of Formula (I) and the compound of Formula (II).

Typically, the polyetheramine of Formula (I) or Formula (II) has a weight average molecular weight of less than about grams/mole 1000 grams/mole, preferably from about 100 to about 800 grams/mole, more preferably from about 200 to about 450 grams/mole.

The polyetheramine can comprise a polyetheramine mixture comprising at least 90%, by weight of the polyetheramine mixture, of the polyetheramine of Formula (I), the polyetheramine of Formula (II), the polyetheramine of Formula (III) or a mixture thereof. Preferably, the polyetheramine comprises a polyetheramine mixture comprising at least 95%, by weight of the polyetheramine mixture, of the polyetheramine of Formula (I), the polyetheramine of Formula (II) and the polyetheramine of Formula (III).

The polyetheramine of Formula (I) and/or the polyetheramine of Formula (II), are obtainable by:

a) reacting a 1,3-diol of formula (1) with a $C_2$-$C_{18}$ alkylene oxide to form an alkoxylated 1,3-diol, wherein the molar ratio of 1,3-diol to $C_2$-$C_{18}$ alkylene oxide is in the range of about 1:2 to about 1:10, (1)

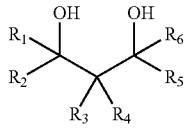

where $R_1$-$R_6$ are independently selected from H, alkyl, cycloalkyl, aryl, alkylaryl, or arylalkyl, where at least one of $R_1$-$R_6$ is different from H;

b) aminating the alkoxylated 1,3-diol with ammonia.

The molar ratio of 1,3-diol to $C_2$-$C_{18}$ alkylene oxide is preferably in the range of about 1:3 to about 1:8, more typically in the range of about 1:4 to about 1:6. Preferably, the $C_2$-$C_{18}$ alkylene oxide is selected from ethylene oxide, propylene oxide, butylene oxide or a mixture thereof. More preferably, the $C_2$-$C_{18}$ alkylene oxide is propylene oxide.

In the 1,3-diol of formula (1), $R_1$, $R_2$, $R_5$, and $R_6$ are H and $R_3$ and $R_4$ are $C_{1-16}$ alkyl or aryl. Preferably, the 1,3-diol of formula (1) is selected from 2-butyl-2-ethyl-1,3-propanediol, 2-methyl-2-propyl-1,3-propanediol, 2-methyl-2-phenyl-1,3-propanediol, 2,2-dimethyl-1,3-propandiol, 2-ethyl-1,3-hexandiol, or a mixture thereof.

Step a): Alkoxylation

The 1,3-diols of Formula (1) are synthesized as described in WO10026030, WO10026066, WO09138387, WO09153193, and WO10010075. Suitable 1,3-diols include 2,2-dimethyl-1,3-propane diol, 2-butyl-2-ethyl-1,3-propane diol, 2-pentyl-2-propyl-1,3-propane diol, 2-(2-methyl)butyl-2-propyl-1,3-propane diol, 2,2,4-trimethyl-1,3-propane diol, 2,2-diethyl-1,3-propane diol, 2-methyl-2-propyl-1,3-propane diol, 2-ethyl-1,3-hexane diol, 2-phenyl-2-methyl-1,3-propane diol, 2-methyl-1,3-propane diol, 2-ethyl-2-methyl-1,3 propane diol, 2,2-dibutyl-1,3-propane diol, 2,2-di(2-methylpropyl)-1,3-propane diol, 2-isopropyl-2-methyl-1,3-propane diol, or a mixture thereof. In some aspects, the 1,3-diol is selected from 2-butyl-2-ethyl-1,3-propanediol, 2-methyl-2-propyl-1,3-propanediol, 2-methyl-2-phenyl-1,3-propanediol, or a mixture thereof. Typically used 1,3-diols are 2-butyl-2-ethyl-1,3-propanediol, 2-methyl-2-propyl-1,3-propanediol, 2-methyl-2-phenyl-1,3-propanediol.

An alkoxylated 1,3-diol may be obtained by reacting a 1,3-diol of Formula I with an alkylene oxide, according to any number of general alkoxylation procedures known in the art. Suitable alkylene oxides include $C_2$-$C_{18}$ alkylene oxides, such as ethylene oxide, propylene oxide, butylene oxide, pentene oxide, hexene oxide, decene oxide, dodecene oxide, or a mixture thereof. In some aspects, the $C_2$-$C_{18}$ alkylene oxide is selected from ethylene oxide, propylene oxide, butylene oxide, or a mixture thereof. A 1,3-diol may be reacted with a single alkylene oxide or combinations of two or more different alkylene oxides. When using two or more different alkylene oxides, the resulting polymer may be obtained as a block-wise structure or a random structure.

Typically, the molar ratio of 1,3-diol to $C_2$-$C_{18}$ alkylene oxide at which the alkoxylation reaction is carried out is in the range of about 1:2 to about 1:10, more typically about 1:3 to about 1:8, even more typically about 1:4 to about 1:6.

The alkoxylation reaction generally proceeds in the presence of a catalyst in an aqueous solution at a reaction temperature of from about 70° C. to about 200° C. and typically from about 80° C. to about 160° C. The reaction may proceed at a pressure of up to about 10 bar or up to about 8 bar. Examples of suitable catalysts include basic catalysts, such as alkali metal and alkaline earth metal hydroxides, e.g., sodium hydroxide, potassium hydroxide and calcium hydroxide, alkali metal alkoxides, in particular sodium and potassium $C_1$-$C_4$-alkoxides, e.g., sodium methoxide, sodium ethoxide and potassium tert-butoxide, alkali metal and alkaline earth metal hydrides, such as sodium hydride and calcium hydride, and alkali metal carbonates, such as sodium carbonate and potassium carbonate. In some aspects, the catalyst is an alkali metal hydroxides, typically potassium hydroxide or sodium hydroxide. Typical use amounts for the catalyst are from about 0.05 to about 10% by weight, in particular from about 0.1 to about 2% by weight, based on the total amount of 1,3-diol and alkylene oxide.

Alkoxylation with x+y $C_2$-$C_{18}$ alkylene oxides and/or $x_1$+$y_1$ $C_2$-$C_{18}$ alkylene oxides produces structures as represented by Formula 2 and/or Formula 3:

Formula (2)

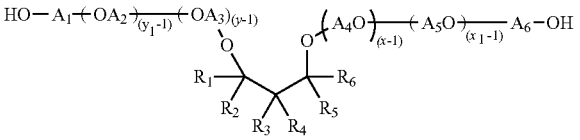

Formula (3)

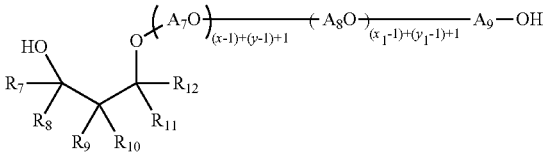

where $R_1$-$R_{12}$ are independently selected from H, alkyl, cycloalkyl, aryl, alkylaryl, or arylalkyl, where at least one of $R_1$-$R_6$ and at least one of $R_7$-$R_{12}$ is different from H, each of $A_1$-$A_9$ is independently selected from linear or branched alkylenes having 2 to 18 carbon atoms, typically 2-10 carbon atoms, more typically 2-5 carbon atoms, and the sum of x+y is in the range of about 2 to about 200, typically about 2 to about 20, more typically about 2 to about 10 or about 2 to about 5, where x≥1 and y≥1, and the sum of $x_1$+$y_1$ is in the range of about 2 to about 200, typically about 2 to about 20, more typically about 2 to about 10 or about 2 to about 5, where $x_1$≥1 and $y_1$≥1.

Step b): Amination

Amination of the alkoxylated 1,3-diols produces structures represented by Formula I or Formula II:

Formula I

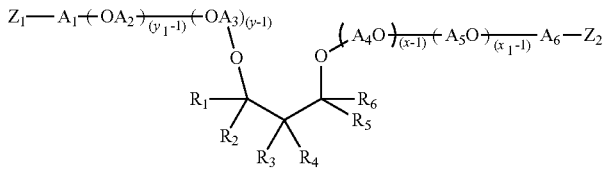

Formula (II)

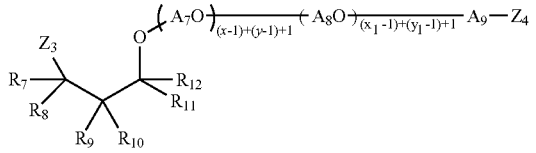

where each of $R_1$-$R_{12}$ is independently selected from H, alkyl, cycloalkyl, aryl, alkylaryl, or arylalkyl, where at least one of $R_1$-$R_6$ and at least one of $R_7$-$R_{12}$ is different from H, each of $A_1$-$A_9$ is independently selected from linear or branched alkylenes having 2 to 18 carbon atoms, typically 2-10 carbon atoms, more typically, 2-5 carbon atoms, each of $Z_1$-$Z_4$ is independently selected from OH or $NH_2$, where at least one of $Z_1$-$Z_2$ and at least one of $Z_3$-$Z_4$ is $NH_2$, where the sum of x+y is in the range of about 2 to about 200, typically about 2 to about 20, more typically about 2 to about 10 or about 2 to about 5, where $x \geq 1$ and $y \geq 1$, and the sum of $x_1+y_1$ is in the range of about 2 to about 200, typically about 2 to about 20, more typically about 2 to about 10 or about 2 to about 5, where $x_1 \geq 1$ and $y_1 \geq 1$.

Polyetheramines according to Formula I and/or Formula II are obtained by reductive amination of the alkoxylated 1,3-diol mixture (Formula 2 and Formula 3) with ammonia in the presence of hydrogen and a catalyst containing nickel. Suitable catalysts are described in WO 2011/067199A1, WO2011/067200A1, and EP0696572 B1. Preferred catalysts are supported copper-, nickel-, and cobalt-containing catalysts, where the catalytically active material of the catalyst, before the reduction thereof with hydrogen, comprises oxygen compounds of aluminum, copper, nickel, and cobalt, and, in the range of from about 0.2 to about 5.0% by weight of oxygen compounds, of tin, calculated as SnO. Other suitable catalysts are supported copper-, nickel-, and cobalt-containing catalysts, where the catalytically active material of the catalyst, before the reduction thereof with hydrogen, comprises oxygen compounds of aluminum, copper, nickel, cobalt and tin, and, in the range of from about 0.2 to about 5.0% by weight of oxygen compounds, of yttrium, lanthanum, cerium and/or hafnium, each calculated as $Y_2O_3$, $La_2O_3$, $Ce_2O_3$ and $Hf_2O_3$, respectively. Another suitable catalyst is a zirconium, copper, and nickel catalyst, where the catalytically active composition comprises from about 20 to about 85% by weight of oxygen-containing zirconium compounds, calculated as $ZrO_2$, from about 1 to about 30% by weight of oxygen-containing compounds of copper, calculated as CuO, from about 30 to about 70% by weight of oxygen-containing compounds of nickel, calculated as NiO, from about 0.1 to about 5% by weight of oxygen-containing compounds of aluminium and/or manganese, calculated as $Al_2O_3$ and $MnO_2$ respectively.

For the reductive amination step, a supported as well as non-supported catalyst may be used. The supported catalyst is obtained, for example, by deposition of the metallic components of the catalyst compositions onto support materials known to those skilled in the art, using techniques which are well-known in the art, including without limitation, known forms of alumina, silica, charcoal, carbon, graphite, clays, mordenites; and molecular sieves, to provide supported catalysts as well. When the catalyst is supported, the support particles of the catalyst may have any geometric shape, for example spheres, tablets, or cylinders, in a regular or irregular version. The process may be carried out in a continuous or discontinuous mode, e.g. in an autoclave, tube reactor, or fixed-bed reactor. The feed thereto may be upflowing or downflowing, and design features in the reactor which optimize plug flow in the reactor may be employed. The degree of amination is from about 50% to about 100%, typically from about 60% to about 100%, and more typically from about 70% to about 100%.

The degree of amination is calculated from the total amine value (AZ) divided by sum of the total acetylables value (AC) and tertiary amine value (tert. AZ) multiplied by 100: (Total AZ: (AC+tert. AZ))×100). The total amine value (AZ) is determined according to DIN 16945. The total acetylables value (AC) is determined according to DIN 53240. The secondary and tertiary amines are determined according to ASTM D2074-07.

The hydroxyl value is calculated from (total acetylables value+tertiary amine value)−total amine value. The polyetheramines of the invention are effective for removal of greasy soils, in particular removal of crystalline grease.

Especially preferred for use herein is a polyethylene amine of Formula (I) having the following structure formula:

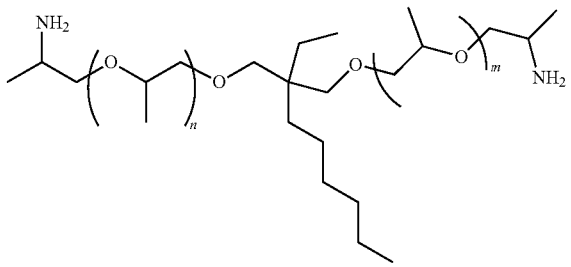

wherein n+m is from 0 to 8. Preferably n+m is from 0 to 6 and more preferably from 1 to 6.

The polyetheramine may be a polyetheramine of Formula (III),

Formula (III)

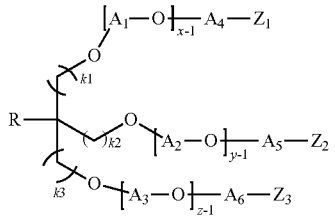

wherein

R is selected from H or a C1-C6 alkyl group, each of $k_1$, $k_2$, and $k_3$ is independently selected from 0, 1, 2, 3, 4, 5, or 6, each of $A_1$, $A_2$, $A_3$, $A_4$, $A_5$, and $A_6$ is independently selected from a linear or branched alkylene group having from about 2 to about 18 carbon atoms or mixtures thereof, $x \geq 1$, $y \geq 1$, and $z \geq 1$, and the sum of x+y+z is in the range of from about 3 to about 100, and each of $Z_1$, $Z_2$, and $Z_3$ is independently selected from $NH_2$ or OH, where at least two of $Z_1$, $Z_2$, and $Z_3$ are $NH_2$.

Preferably, R is H or a C1-C6 alkyl group selected from methyl, ethyl, or propyl. In some aspects, R is H or a C1-C6 alkyl group selected from ethyl.

Preferably, each of $k_1$, $k_2$, and $k_3$ is independently selected from 0, 1, or 2. Each of $k_1$, $k_2$, and $k_3$ may be independently selected from 0 or 1. More preferably, at least two of $k_1$, $k_2$, and $k_3$ are 1 and even more preferably, each of $k_1$, $k_2$, and $k_3$ is 1.

Preferably, each of $Z_1$, $Z_2$, and $Z_3$ is $NH_2$.

All A groups (i.e., $A_1$-$A_6$) may be the same, at least two A groups may be the same, at least two A groups may be different, or all A groups may be different from each other. Each of $A_1$, $A_2$, $A_3$, $A_4$, $A_5$, and $A_6$ may be independently selected from a linear or branched alkylene group having from about 2 to about 10 carbon atoms, or from about 2 to about 6 carbon atoms, or from about 2 to about 4 carbon atoms, or mixtures thereof. Preferably, at least one, or at least three, of $A_1$-$A_6$ is a linear or branched butylene group. More preferably, each of $A_4$, $A_5$, and $A_6$ is a linear or branched butylene group. Especially, each of $A_1$-$A_6$ is a linear or branched butylene group.

Preferably, x, y, and/or z are independently selected and should be equal to 3 or greater, meaning that that the polyetheramine may have more than one [$A_1$-O] group, more than one [$A_2$-O] group, and/or more than one [$A_3$-O] group. Preferably, $A_1$ is selected from ethylene, propylene, butylene, or mixtures thereof. Preferably, $A_2$ is selected from ethylene, propylene, butylene, or mixtures thereof. Preferably, $A_3$ is selected from ethylene, propylene, butylene, or mixtures thereof. When $A_1$, $A_2$, and/or $A_3$ are mixtures of ethylene, propylene, and/or butylenes, the resulting alkoxylate may have a block-wise structure or a random structure. $[A_1\text{-}O]_{x-1}$ can be selected from ethylene oxide, propylene oxide, butylene oxide, or mixtures thereof. $[A_2\text{-}O]_{y-1}$ can be selected from ethylene oxide, propylene oxide, butylene oxide, or mixtures thereof. $[A_3\text{-}O]_{z-1}$ can be selected from ethylene oxide, propylene oxide, butylene oxide, or mixtures thereof.

Preferably, the sum of x+y+z is in the range of from about 3 to about 100, or from about 3 to about 30, or from about 3 to about 10, or from about 5 to about 10.

Typically, the polyetheramines of the present invention have a weight average molecular weight of from about 150, or from about 200, or from about 350, or from about 500 grams/mole, to about 1000, or to about 900, or to about 800 grams/mole.

Preferably, when the polyetheramine is a polyetheramine of Formula (III) where R is a C2 alkyl group (i.e., ethyl) and optionally each of $k_1$, $k_2$, and $k_3$ is 1, the molecular weight of the polyetheramine is from about 500 to about 1000, or to about 900, or to about 800 grams/mole. It is also preferred, when the polyetheramine is a polyetheramine of Formula (III) where R is a C2 alkyl group (i.e., ethyl) and optionally each of $k_1$, $k_2$, and $k_3$ is 1, at least one A group (i.e., at least one of A1, A2, A3, A4, A5, or A6) is not a propylene group. It is also preferred, when the polyetheramine is a polyetheramine of Formula (III) where R is a C2 alkyl group (i.e., ethyl) and optionally each of $k_1$, $k_2$, and $k_3$ is 1, at least one A group (i.e., at least one of A1, A2, A3, A4, A5, or A6) is a ethylene group or a butylene group, or more typically at least one A group (i.e., at least one of A1, A2, A3, A4, A5, or A6) is a butylene group.

Polyetheramine with the following structure are preferred for use herein:

Formula C

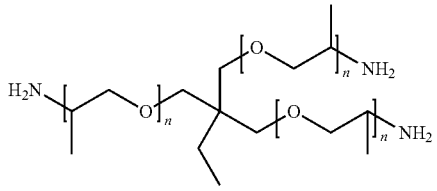

where average n is from about 0.5 to about 5, or from about 1 to about 3, or from about 1 to about 2.5.

Other preferred polyetheramines are selected from the group consisting of Formula C, Formula D, Formula E, and mixtures thereof:

Formula D

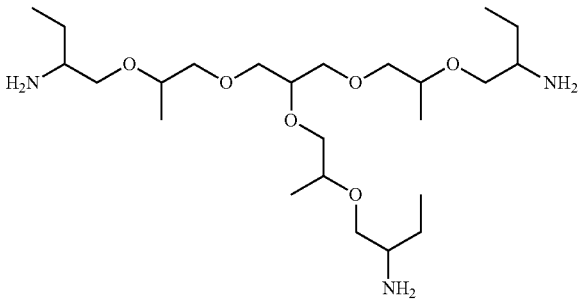

Formula E

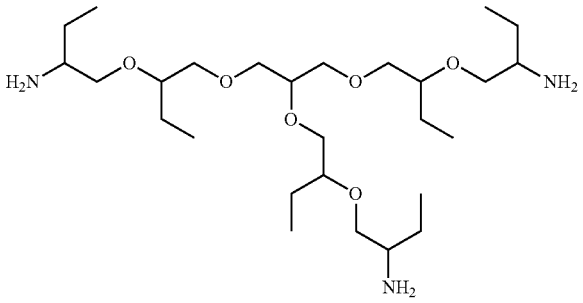

-continued

Formula C

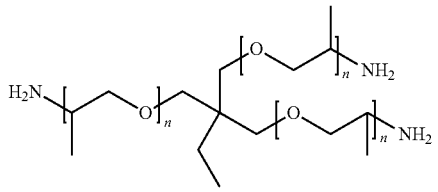

where average n is from about 0.5 to about 5.

The polyetheramines of Formula (III) of the present invention may be obtained by a process comprising the following steps:

a) reacting a low-molecular-weight, organic triol, such as glycerine and/or 1,1,1-trimethylolpropane, with $C_2$-$C_{18}$ alkylene oxide, to form an alkoxylated triol, where the molar ratio of the low-molecular-weight organic triol to the alkylene oxide is in the range of about 1:3 to about 1:10, and b) aminating the alkoxylated triol with ammonia.

This process is described in more detail below.

Alkoxylation

Polyetheramines according to Formula (III) may be obtained by reductive amination of an alkoxylated triol. Alkoxylated triols according to the present disclosure may be obtained by reaction of low-molecular-weight, organic triols, such as glycerine and/or 1,1,1-trimethylolpropane, with alkylene oxides according to general alkoxylation procedures known in the art.

By "low-molecular-weight," it is meant that the triol has a molecular weight of from about 64 to about 500, or from about 64 to about 300, or from about 78 to about 200, or from about 92 to about 135 g/mol. The triol may be water soluble.

A low-molecular-weight, organic triol useful herein (or simply "low-molecular-weight triol," as used herein) has the structure of Formula (4):

Formula (4)

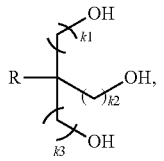

where R is selected from H or a C1-C6 alkyl group, and where each k is independently selected from 0, 1, 2, 3, 4, 5, or 6. Preferably, R is H or a C1-C6 alkyl group selected from methyl, ethyl, or propyl. More preferably, R is H or ethyl. $k_1$, $k_2$, and $k_3$ can each be independently selected from 0, 1, or 2. Each of $k_1$, $k_2$, and $k_3$ may be independently selected from 0 or 1. Preferably, at least two of $k_1$, $k_2$, and $k_3$ are 1. More preferably, all three of $k_1$, $k_2$, and $k_3$ are 1.

The low-molecular-weight triol can be selected from glycerine, 1,1,1-trimethylolpropane, or mixtures thereof.

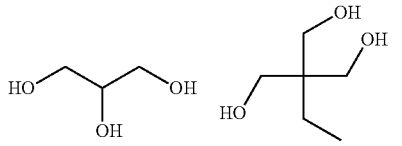

glycerine 1,1,1-trimethylolpropane

The alkoxylated triol, such as alkoxylated glycerine or alkoxylated 1,1,1-trimethylolpropane, may be prepared in a known manner by reaction of the low-molecular-weight triol with an alkylene oxide. Suitable alkylene oxides are linear or branched $C_2$-$C_{18}$ alkylene oxides, typically $C_2$-$C_{10}$ alkylene oxides, more typically $C_2$-$C_6$ alkylene oxides or $C_2$-$C_4$ alkylene oxides. Suitable alkylene oxides include ethylene oxide, propylene oxide, butylene oxide, pentene oxide, hexene oxide, decene oxide, and dodecene oxide. In some aspects, the $C_2$-$C_{18}$ alkylene oxide is selected from ethylene oxide, propylene oxide, butylene oxide, or a mixture thereof. In some aspects, the $C_2$-$C_{18}$ alkylene oxide is butylene oxide, optionally in combination with other $C_2$-$C_{18}$ alkylene oxides.

The low molecular weight triols, such as glycerine or 1,1,1-trimethylolpropane, may be reacted with one single type of alkylene oxide or combinations of two or more different types of alkylene oxides, e.g., ethylene oxide and propylene oxide. If two or more different types of alkylene oxides are used, the resulting alkoxylate may have a blockwise structure or a random structure.

Typically, the molar ratio of low-molecular-weight triol to $C_2$-$C_{18}$ alkylene oxide at which the alkoxylation reaction is carried out is in the range of about 1:3 to about 1:10, more typically about 1:3 to about 1:6, even more typically about 1:4 to about 1:6. In some aspects, the molar ratio of low-molecular-weight triol to $C_2$-$C_{18}$ alkylene oxide at which the alkoxylation reaction is carried out is in the range of about 1:5 to about 1:10.

When the low-molecular-weight triol is 1,1,1-trimethylolpropane, or when R of the triol of Formula (2) is a C2 alkyl and each of $k_1$, $k_2$, and $k_3$ are 1, the polyetheramine has a weight average molecular weight of from about 500 to about 1000, or to about 900, or to about 800 grams/mole.

The reaction is generally performed in the presence of a catalyst in an aqueous solution at a reaction temperature of from about 70° C. to about 200° C., and typically from about 80° C. to about 160° C. This reaction may be performed at a pressure of up to about 10 bar, or up to about 8 bar.

Examples of suitable catalysts are basic catalysts such as alkali metal and alkaline earth metal hydroxides, such as sodium hydroxide, potassium hydroxide and calcium hydroxide, alkali metal alkoxides, in particular sodium and potassium $C_1$-$C_4$-alkoxides, such as sodium methoxide, sodium ethoxide and potassium tert-butoxide, alkali metal and alkaline earth metal hydrides, such as sodium hydride and calcium hydride, and alkali metal carbonates, such as sodium carbonate and potassium carbonate. Alkali metal hydroxides, such as potassium hydroxide and sodium hydroxide, are particularly suitable. Typical use amounts for the basic catalyst are from about 0.05 to about 10% by weight, in particular from about 0.1 to about 2% by weight, based on the total amount of the low-molecular-weight triol and the alkylene oxide.

Amination

Polyetheramines according to Formula (III) may be obtained by reductive amination of an alkoxylated triol, such as those described above, for example alkoxylated glycerine or alkoxylated 1,1,1-trimethylolpropane, with ammonia in the presence of hydrogen and a catalyst, such as a catalyst containing nickel. Suitable catalysts are described in WO 2011/067199 A1, in WO2011/067200 A1, and in EP0696572 B1.

The amination may be carried out in the presence of copper-, nickel- or cobalt-containing catalyst. Preferred catalysts are supported copper-, nickel- and cobalt-containing catalysts, wherein the catalytically active material of the catalysts, before the reduction thereof with hydrogen, comprises oxygen compounds of aluminium, copper, nickel and cobalt, and, in the range of from about 0.2% to about 5.0% by weight, of oxygen compounds of tin, calculated as SnO. Other preferred catalysts are supported copper-, nickel- and cobalt-containing catalysts, wherein the catalytically active material of the catalysts, before the reduction thereof with hydrogen, comprises oxygen compounds of aluminium, copper, nickel, cobalt, tin, and, in the range of from about 0.2 to about 5.0% by weight, of oxygen compounds of yttrium, lanthanum, cerium and/or hafnium, each calculated as $Y_2O_3$, $La_2O_3$, $Ce_2O_3$ and $Hf_2O_3$, respectively. Another suitable catalyst is a zirconium, copper, nickel catalyst, wherein the catalytically active composition comprises from about 20 to about 85% by weight of oxygen-containing zirconium compounds, calculated as $ZrO_2$, from about 1 to about 30% by weight of oxygen-containing compounds of copper, calculated as CuO, from about 30 to about 70% by weight of oxygen-containing compounds of nickel, calculated as NiO, from about 0.1 to about 5% by weight of oxygen-containing compounds of aluminium and/or manganese, calculated as $Al_2O_3$ and $MnO_2$, respectively.

For the reductive amination step, a supported as well as a non-supported catalyst can be used. The supported catalyst may be obtained by deposition of the metallic components of the catalyst compositions onto support materials known to those skilled in the art, using techniques that are well-known in the art, including, without limitation, known forms of alumina, silica, charcoal, carbon, graphite, clays, mordenites; molecular sieves may be used to provide supported catalysts as well. When the catalyst is supported, the support particles of the catalyst may have any geometric shape, for example, the shape of spheres, tablets, or cylinders in a regular or irregular version.

The process can be carried out in a continuous or discontinuous mode, e.g., in an autoclave, tube reactor, or fixed-bed reactor. A number of reactor designs may be used. For example, the feed thereto may be upflowing or downflowing, and design features in the reactor that optimize plug flow in the reactor may be employed.

The degree of amination may be from about 67% to about 100%, or from about 85% to about 100%. The degree of amination is calculated from the total amine value (AZ) divided by sum of the total acetylables value (AC) and tertiary amine value (tert. AZ) multiplied by 100 (Total AZ/((AC+tert. AZ)×100)).

The total amine value (AZ) is determined according to DIN 16945.

The total acetylables value (AC) is determined according to DIN 53240.

The secondary and tertiary amines are determined according to ASTM D2074-07.

The hydroxyl value is calculated from (total acetylables value+tertiary amine value)−total amine value.

Amine of Formula (1):

The cleaning amine of Formula (1) has an ethylene diamine core with at least one primary amine functionality. The cleaning amine also comprises at least another nitrogen atom, preferable in the form of a tertiary amine functionality. Herein the term "core" refers to the alkyl chain between two nitrogen radicals. The number of carbons in the core does not include the radicals attached to the core.

The cleaning amine has the formula:

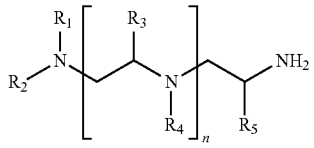

wherein: $R_1$, $R_2$, $R_3$, $R_4$, and $R_5$ are independently selected from —H, linear, branched or cyclic alkyl or alkenyl having from 1 to 10 carbon atoms and n=0-3.

Preferably, the cleaning amine is aliphatic in nature. The cleaning amine preferably has a molecular weight of less than about 1000 grams/mole and more preferably less than about 450 grams/mole.

"n" varies from 0 to not more than 3, preferably "n" is 0. The amine molecule contains at least one primary amine functionality and preferably a tertiary amine functionality.

Suitable cleaning amines for use herein include amines wherein $R_1$ and $R_2$ are selected from isopropyl and butyl, preferably $R_1$ and $R_2$ are both isopropyl or both butyl.

Preferably cleaning amines include those in which R1 and R2 are isopropyl and preferably, n is 0. Also preferred are amines in which R1 and R2 are butyl and preferably, n is 0

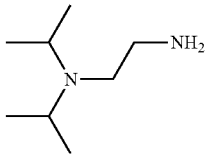

$N_1$,$N_1$-diisopropylethane-1,2-diamine

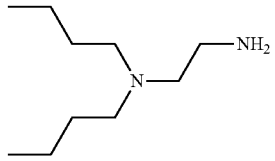

$N^1$,$N^1$-dibutylethane-1,2-diamine

R5 is preferably —CH3 or —CH2CH3. Cleaning amines in which R5 is —CH3 or —CH2CH3 could be good in terms of composition stability. Without being bound by theory, it is believed that the methyl or ethyl radical can provide stearic hinderance that protects the cleaning amine from negative interaction with other components of the cleaning composition.

Amine of Formula (2):

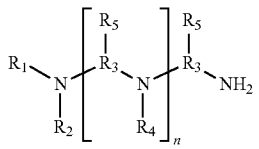

wherein $R_1$ and $R_4$ are independently selected from —H, linear, branched or cyclic alkyl or alkenyl; having from 1 to 10 carbon atoms and $R_2$ is a linear, branched or cyclic alkyl or alkenyl having from 3 to 10 carbons, $R_3$ is a linear or branched alkyl from 3 to 6 carbon atoms, $R_5$ is H, methyl or ethyl and is preferably located in alpha position from the amine functionality/ies, and n=0-3.

The cleaning amine of formula (2) has a C3-C6 diamine core with at least one of the amine functionalities being a primary amine. Herein the term "core" refers to the alkyl chain between two nitrogen radicals. The number of carbons in the core does not include the radicals attached to the core.

The cleaning amine of formula (2) preferably has a molecular weight of less than about 1000 grams/mole and more preferably less than about 450 grams/mole.

"n" varies from 0 to not more than 3, preferably "n" is 0. The amine molecule contains at least one primary amine functionality and preferably a tertiary amine functionality.

Suitable cleaning amines include amines wherein $R_1$ and $R_2$ are selected from propyl, butyl and hexyl, preferably $R_1$ and $R_2$ are both propyl, butyl or hexyl. Preferably n is 0.

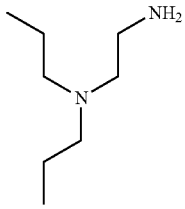

N′N′-dipropylpropane 1,3 ldiamine

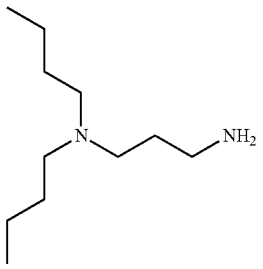

$N^1N^1$-dibutylpropane-1,3-diamine

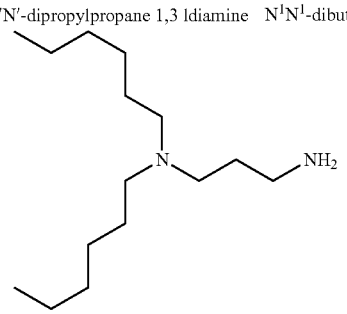

$N^1N'$-dihexylpropane-1,3-diamine

Another preferred cleaning amine for use herein is cyclohexyl propylenediamine (wherein n=0, R1 is cyclohexanyl and R2 is H)

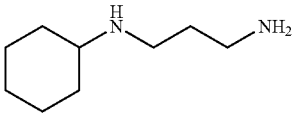

Non-Ionic Surfactant

The composition of the invention can comprise a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated non-ionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R1O[CH2CH(CH3)O]_x[CH2CH2O]_y[CH2CH(OH)R2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit [CH2CH(OH) R2]. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Non-ionic surfactants may be present in amounts from 0 to 10% by weight, preferably from 0.1% to 10%, and most preferably from 0.25% to 6% by weight of the total composition.

Builders

The composition of the invention is preferably phosphate free. Preferred non-phosphate builders include aminocarboxylic builders such as MGDA (methyl-glycine-diacetic acid), GLDA (glutamic-N,N-diacetic acid), iminodisuccinic acid (IDS), carboxymethyl inulin and salts and derivatives thereof.

In addition to the aminocarboxylic builders the composition can comprise carbonate and/or citrate. Preferably the composition is free of silicates.

Preferably builders are present in an amount of up to 70%, more preferably up to 45%, even more preferably up to 40%, and especially up to 35% by weight of the composition. In preferred embodiments the composition contains 20% by weight of the composition or less of phosphate builders, more preferably 10% by weight of the composition or less, most preferably they are substantially free of phosphate builders.

Suds Suppressor

Suds suppressors can be an alkyl phosphate ester suds suppressor, a silicone suds suppressor, or combinations thereof. Suds suppressor technology and other defoaming agents useful herein are documented in "Defoaming, Theory and Industrial Applications," Ed., P. R. Garrett, Marcel Dekker, N.Y., 1973, incorporated herein by reference.

Suds suppressors are preferably included in the automatic dishwashing detergent composition. The suds suppressor is included in the composition at a level of from about 0.0001% to about 10%, in another embodiment from about 0.001% to about 5%, from about 0.01% to about 1.5%, from about 0.01% to about 0.5%, by weight of the composition.

Silicone based suds suppressor are quite suited for the compositions of the invention. Silicone suds suppressor technology and other defoaming agents useful herein are extensively documented in "Defoaming, Theory and Industrial Applications", Ed., P. R. Garrett, Marcel Dekker, N.Y., 1973, ISBN 0-8247-8770-6, incorporated herein by reference. See especially the chapters entitled "Foam control in Detergent Products" (Ferch et al) and "Surfactant Antifoams" (Blease et al). See also U.S. Pat. Nos. 3,933,672 and 4,136,045. In one embodiment, the silicone based suds suppressors is polydimethylsiloxanes having trimethylsilyl, or alternate end blocking units may be used as the silicone. These may be compounded with silica and/or with surface-active nonsilicon components, as illustrated by a suds suppressor comprising 12% silicone/silica, 18% stearyl alcohol and 70% starch in granular form. A suitable commercial source of the silicone active compounds is Dow Corning Corp. Silicone based suds suppressors are useful in that the silica works well to suppress the foam generated by the high foaming non-ionic surfactant.

Other silicone based suds suppressor comprises solid silica, in another embodiment, a silicone fluid, in another embodiment a silicone resin, in another embodiment, silica. The silicone based suds suppressor can be in the form of a granule, in another embodiment, a liquid.

The silicone based suds suppressor can comprise dimethylpolysiloxane, a hydrophilic polysiloxane compound having polyethylenoxy-propylenoxy group in the side chain, and a micro-powdery silica.

A phosphate ester suds suppressor may also be used. Suitable alkyl phosphate esters contain from 16-20 carbon atoms. Such phosphate ester suds suppressors may be monostearyl acid phosphate or monooleyl acid phosphate or salts thereof, in one embodiment alkali metal salts.

Other suitable suds suppressors are calcium precipitating fatty acid soaps. However, it has been found to avoid the use of simple calcium-precipitating soaps as antifoams in the present composition as they tend to deposit on dishware. Indeed, fatty acid based soaps are not entirely free of such problems and the formulator will generally choose to minimize the content of potentially depositing antifoams in the instant composition.

Dispersant Polymer

The polymer, if present, is used in any suitable amount from about 0.1% to about 30%, preferably from 0.5% to about 20%, more preferably from 1% to 10% by weight of the composition. Sulfonated/carboxylated polymers are particularly suitable for the composition of the invention.

Suitable sulfonated/carboxylated polymers described herein may have a weight average molecular weight of less than or equal to about 100,000 Da, or less than or equal to about 75,000 Da, or less than or equal to about 50,000 Da, or from about 3,000 Da to about 50,000, preferably from about 5,000 Da to about 45,000 Da.

As noted herein, the sulfonated/carboxylated polymers may comprise (a) at least one structural unit derived from at least one carboxylic acid monomer having the general formula (I):

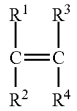

(I)

wherein R1 to R4 are independently hydrogen, methyl, carboxylic acid group or CH2COOH and wherein the carboxylic acid groups can be neutralized; (b) optionally, one or more structural units derived from at least one nonionic monomer having the general formula (II):

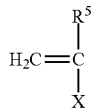

(II)

wherein R5 is hydrogen, C1 to C6 alkyl, or C1 to C6 hydroxyalkyl, and X is either aromatic (with R5 being hydrogen or methyl when X is aromatic) or X is of the general formula (III):

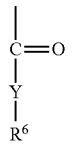

(III)

wherein R6 is (independently of R5) hydrogen, C1 to C6 alkyl, or C1 to C6 hydroxyalkyl, and Y is O or N; and at least one structural unit derived from at least one sulfonic acid monomer having the general formula (IV):

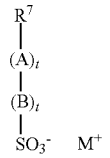

(IV)

wherein R7 is a group comprising at least one sp2 bond, A is O, N, P, S or an amido or ester linkage, B is a mono- or polycyclic aromatic group or an aliphatic group, each t is independently 0 or 1, and M+ is a cation. In one aspect, R7 is a C2 to C6 alkene. In another aspect, R7 is ethene, butene or propene.

Preferred carboxylic acid monomers include one or more of the following: acrylic acid, maleic acid, itaconic acid, methacrylic acid, or ethoxylate esters of acrylic acids, acrylic and methacrylic acids being more preferred. Preferred sulfonated monomers include one or more of the following: sodium (meth) allyl sulfonate, vinyl sulfonate, sodium phenyl (meth) allyl ether sulfonate, or 2-acrylamidomethyl propane sulfonic acid. Preferred non-ionic monomers include one or more of the following: methyl (meth) acrylate, ethyl (meth) acrylate, t-butyl (meth) acrylate, methyl (meth) acrylamide, ethyl (meth) acrylamide, t-butyl (meth) acrylamide, styrene, or α-methyl styrene.

Preferably, the polymer comprises the following levels of monomers: from about 40 to about 90%, preferably from about 60 to about 90% by weight of the polymer of one or more carboxylic acid monomer; from about 5 to about 50%, preferably from about 10 to about 40% by weight of the polymer of one or more sulfonic acid monomer; and optionally from about 1% to about 30%, preferably from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

The carboxylic acid is preferably (meth)acrylic acid. The sulfonic acid monomer is preferably one of the following: 2-acrylamido methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, allyloxybenzenesulfonic acid, methallyloxybenzensulfonic acid, 2-hydroxy-3-(2-propenyloxyl) propanesulfonic acid, 2-methyl-2-propene-1-sulfonic acid, styrene sulfonic acid, vinylsulfonic acid, 3-sulfopropyl acrylate, 3-sulfopropyl methacrylate, sulfomethylacrylamid, sulfomethylmethacrylamide, and water soluble salts thereof. The unsaturated sulfonic acid monomer is most preferably 2-acrylamido-2-propanesulfonic acid (AMPS).

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

Other suitable organic polymer for use herein includes a polymer comprising an acrylic acid backbone and alkoxylated side chains, said polymer having a molecular weight of from about 2,000 to about 20,000, and said polymer having from about 20 wt % to about 50 wt % of an alkylene oxide. The polymer should have a molecular weight of from about 2,000 to about 20,000, or from about 3,000 to about 15,000, or from about 5,000 to about 13,000. The alkylene oxide (AO) component of the polymer is generally propylene oxide (PO) or ethylene oxide (EO) and generally comprises from about 20 wt % to about 50 wt %, or from about 30 wt % to about 45 wt %, or from about 30 wt % to about 40 wt % of the polymer. The alkoxylated side chains of the water soluble polymers may comprise from about 10 to about 55 AO units, or from about 20 to about 50 AO units, or from about 25 to 50 AO units. The polymers, preferably water soluble, may be configured as random, block, graft, or other known configurations. Methods for forming alkoxylated acrylic acid polymers are disclosed in U.S. Pat. No. 3,880,765.

Other suitable polymers for use herein include homopolymers and copolymers of polycarboxylic acids and their partially or completely neutralized salts, monomeric polycarboxylic acids and hydroxycarboxylic acids and their salts. Preferred salts of the abovementioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of, malonic acid, (ethyl enedioxy) diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Other suitable builders are disclosed in WO 95/01416, to the contents of which express reference is hereby made.

Other suitable organic polymer for use herein includes polyaspartic acid (PAS) derivatives as described in WO 2009/095645 A1.

Bleach

Inorganic and organic bleaches are suitable cleaning actives for use herein. Bleach is present is at a level of from about 1 to about 20%, preferably from about 5 to about 15% by weight of composition. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated.

Alkali metal percarbonates, particularly sodium percarbonate are preferred perhydrates for use herein. The percarbonate is most preferably incorporated into the products in a coated form which provides in-product stability. A suitable coating material providing in product stability comprises mixed salt of a water-soluble alkali metal sulfate and carbonate. Such coatings together with coating processes have previously been described in GB-1,466,799. The weight ratio of the mixed salt coating material to percarbonate lies in the range from 1:200 to 1:4, more preferably from 1:99 to 1 9, and most preferably from 1:49 to 1:19. Preferably, the mixed salt is of sodium sulfate and sodium carbonate which has the general formula Na2SO4.n.Na2CO3 wherein n is from 0.1 to 3, preferably n is from 0.3 to 1.0 and most preferably n is from 0.2 to 0.5.

Another suitable coating material providing in product stability, comprises sodium silicate of SiO2:Na20 ratio from 1.8:1 to 3.0:1, preferably L8:1 to 2.4:1, and/or sodium metasilicate, preferably applied at a level of from 2% to 10%, (normally from 3% to 5%) Of SiO2 by weight of the inorganic perhydrate salt. Magnesium silicate can also be included in the coating. Coatings that contain silicate and borate salts or boric acids or other inorganics are also suitable.

Other coatings which contain waxes, oils, fatty soaps can also be used advantageously within the present invention.

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 12 carbon atoms, in particular from 2 to 10 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), decanoyloxybenzoic acid (DOBA), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). The composition of the invention preferably comprises a bleach activator. Preferably in a level of from about 0.01 to about 10%, preferably from about 0.1 to about 5% and more preferably from about 1 to about 4% by weight of the total composition.

Bleach Catalyst

The composition herein contains a bleach catalyst, preferably a metal containing bleach catalyst. More preferably the metal containing bleach catalyst is a transition metal containing bleach catalyst, especially a manganese or cobalt-containing bleach catalyst.

Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes (US-A-4810410). A complete description of bleach catalysts suitable for use herein can be found in WO 99/06521, pages 34, line 26 to page 40, line 16.

Suitable catalysts for use herein include cobalt (III) catalysts having the formula:

$$Co[(NH3)nMmBbTtQqPp]Yy$$

wherein cobalt is in the +3 oxidation state; n is an integer from 0 to 5 (preferably 4 or 5; most preferably 5); M represents a monodentate ligand; m is an integer from 0 to 5 (preferably 1 or 2; most preferably 1); B represents a bidentate ligand; b is an integer from 0 to 2; T represents a tridentate ligand; t is 0 or 1; Q is a tetradentae ligand; q is 0 or 1; P is a pentadentate ligand; p is 0 or 1; and n+m+2b+3t+4q+5p=6; Y is one or more appropriately selected counteranions present in a number y, where y is an integer from 1 to 3 (preferably 2 to 3; most preferably 2 when Y is a −1 charged anion), to obtain a charge-balanced salt, preferred Y are selected from the group consisting of chloride, nitrate, nitrite, sulfate, citrate, acetate, carbonate, and combinations thereof; and wherein further at least one of the coordination sites attached to the cobalt is labile under automatic dishwashing use conditions and the remaining coordination sites stabilize the cobalt under automatic dishwashing conditions such that the reduction potential for cobalt (III) to cobalt (II) under alkaline conditions is less than about 0.4 volts (preferably less than about 0.2 volts) versus a normal hydrogen electrode.

Preferred cobalt catalysts have the formula:

$$[Co(NH3)n(M)m]Yy$$

wherein n is an integer from 3 to 5 (preferably 4 or 5; most preferably 5); M is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); m+n=6; and Y is an appropriately selected counteranion present in a number y, which is an integer from 1 to 3 (preferably 2 to 3; most preferably 2 when Y is a −1 charged anion), to obtain a charge-balanced salt.

The most preferred cobalt catalyst useful herein has the formula [Co(NH3)5Cl] Yy, and especially [Co(NH3)5Cl] C12.

Suitable M, B, T, Q and P ligands for use herein are known, such as those ligands described in U.S. Pat. No. 4,810,410, to Diakun et al, issued Mar. 7, 1989. In addition, examples of M include pryidine and SCN; examples of B include ethylenediamine, bipyridine, acetate, phenthroline, biimidazole, and tropolone; examples of T include terpyridine, acylhydrazones of salicylaldehyde, and diethylenetriamine; examples of Q include triethylenetetramine, N(CH2CH2NH2)3, Schiff bases (for example HOCH2CH2C═NCH2CH2N═CCH2CH2OH); and examples of P include polyimidazoles and HOCH2CH2C═NCH2CH2NH—CH2CH2N═CCH2CH2OH.

These cobalt catalysts are readily prepared by known procedures, such as taught for example in U.S. Pat. No. 4,810,410, to Diakun et al, issued Mar. 7, 1989, and J. Chem. Ed. (1989), 66 (12), 1043-45; The Synthesis and Characterization of Inorganic Compounds, W. L. Jolly (Prentice-Hall; 1970), pp. 461-3.

Manganese bleach catalysts are preferred for use in the composition of the invention. These catalysts in combination with the alkyl ether sulfate provide the best results in terms of removal of bleachable stains. Especially preferred catalyst for use here is a dinuclear manganese-complex having the general formula:

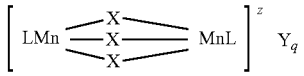

wherein Mn is manganese which can individually be in the III or IV oxidation state; each x represents a coordinating or bridging species selected from the group consisting of H2O, O22-, O2-, OH—, HO2-, SH—, S2-, >SO, Cl—, N3-, SCN—, RCOO—, NH2- and NR3, with R being H, alkyl or aryl, (optionally substituted); L is a ligand which is an organic molecule containing a number of nitrogen atoms which coordinates via all or some of its nitrogen atoms to the manganese centres; z denotes the charge of the complex and is an integer which can be positive or negative; Y is a monovalent or multivalent counter-ion, leading to charge neutrality, which is dependent upon the charge z of the complex; and q=z/[charge Y].

Preferred manganese-complexes are those wherein x is either CH3COO— or O2 or mixtures thereof, most preferably wherein the manganese is in the IV oxidation state and x is O2-. Preferred ligands are those which coordinate via three nitrogen atoms to one of the manganese centres, preferably being of a macrocyclic nature. Particularly preferred ligands are:

(1) 1,4,7-trimethyl-1,4,7-triazacyclononane, (Me-TACN); and (2) 1,2,4,7-tetramethyl-1,4,7-triazacyclononane, (Me-Me TACN).

The type of counter-ion Y for charge neutrality is not critical for the activity of the complex and can be selected from, for example, any of the following counter-ions: chloride; sulfate; nitrate; methylsulfate; surfactant anions, such as the long-chain alkylsulfates, alkylsulphonates, alkylbenzenesulphonates, tosylate, trifluoromethylsulphonate, perchlorate (ClO4-), BPh4-, and PF6-' though some counter-ions are more preferred than others for reasons of product property and safety.

Consequently, the preferred manganese complexes useable in the present invention are:

(I) [(Me-TACN)MnIV(Âμ–0)3MnIV(Me-TACN)2+(PF6-)2

(II) [(Me-MeTACN)MnIV(Âμ–0)3MnIV(Me-MeTACN)]2+(PF6-)2

(III) [(Me-TACN)MnIII(Âμ–0)(Âμ–0Ac)2MnIII(Me-TACN)]2+(PF6-)2

(IV) [(Me-MeTACN)MnIII(Âμ–0)(Âμ–0Ac)2MnIII(Me-MeTACN)]2+(PF6-)2 which hereinafter may also be abbreviated as:

(I) [MnIV2(Âμ–0)3(Me-TACN)2](PF6)2

(II) [MnIV2(Âμ–0)3(Me-MeTACN)2](PF6)2

(III) [MnIII2(Âμ–0) (Âμ–0Ac)2(Me-TACN)2](PF6)2

(IV) [MnIII2(Âμ–0) (Âμ–0Ac)2(Me-TACN) 2](PF6)2

The structure of I is given below:

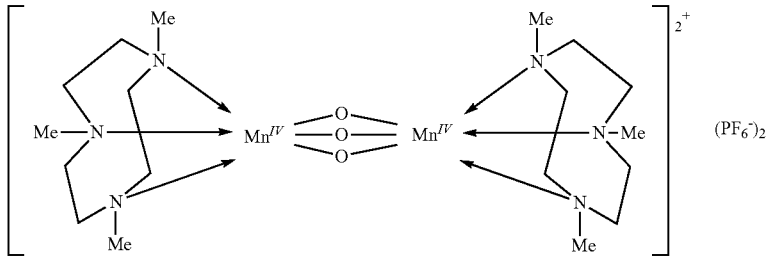

abbreviated as [MnIV2(Âμ–0)3(Me-TACN)2](PF6) 2.

The structure of II is given below:

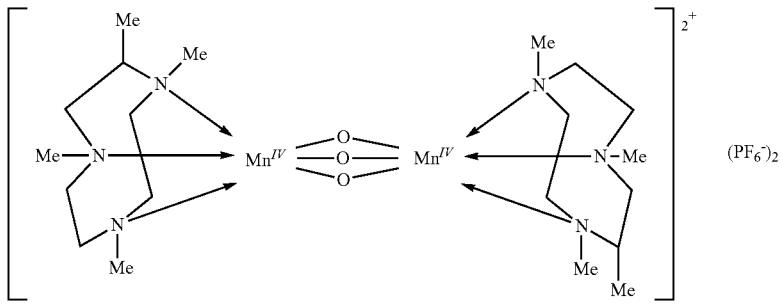

abbreviated as [MnIV2(Âμ–0)3(Me-MeTACN)2](PF6)2

It is of note that the manganese complexes are also disclosed in EP-A-0458397 and EP-A-0458398 as unusually effective bleach and oxidation catalysts. In the further description of this invention they will also be simply referred to as the "catalyst".

The composition of the invention preferably comprises a bleach catalyst. Preferably in a level of from about 0.001 to about 10%, preferably from about 0.05 to about 2% by weight of the total composition.

Enzyme Related Terminology

Nomenclature for Amino Acid Modifications

In describing enzyme variants herein, the following nomenclature is used for ease of reference: Original amino acid(s):position(s):substituted amino acid(s).

According to this nomenclature, for instance the substitution of glutamic acid for glycine in position 195 is shown as G195E. A deletion of glycine in the same position is shown as G195*, and insertion of an additional amino acid residue such as lysine is shown as G195GK. Where a specific enzyme contains a "deletion" in comparison with other enzyme and an insertion is made in such a position this is indicated as *36D for insertion of an aspartic acid in position 36. Multiple mutations are separated by pluses, i.e.: S99G+V102N, representing mutations in positions 99 and 102 substituting serine and valine for glycine and asparagine, respectively. Where the amino acid in a position (e.g. 102) may be substituted by another amino acid selected from a group of amino acids, e.g. the group consisting of N and I, this will be indicated by V102N/I.

In all cases, the accepted IUPAC single letter or triple letter amino acid abbreviation is employed.

Protease Amino Acid Numbering

The numbering used in this patent is numbering versus the specific protease (PB92) listed as SEQ ID No:1. An alternative numbering scheme is the so-called BPN' numbering scheme which is commonly used in the art. For convenience the numbering schemes are compared below in Table 1:

TABLE 1

| Protease Mutation numbering | |
|---|---|
| PB92 numbering of this patent (numbering versus SEQ ID NO: 1 of EP 2 100 949) | Equivalent BPN' numbering |
| G116V + S126L + P127Q + S128A | G118V + S128L + P129Q + S130A |
| G116V + S126N + P127S + S128A + S160D | G118V + S128N + P129S + S130A + S166D |
| G116V + S126L + P127Q + S128A + S160D | G118V + S128L + P129Q + S130A + S166D |
| G116V + S126V + P127E + S128K | G118V + S128V + P129E + S130K |
| G116V + S126V + P127M + S160D | G118V + S128V + P129M + S166D |
| S128T | S130T |
| G116V + S126F + P127L + S128T | G118V + S128F + P129L + S130T |
| G116V + S126L + P127N + S128V | G118V + S128L + P129N + S130V |
| G116V + S126F + P127Q | G118V + S128F + P129Q |
| G116V + S126V + P127E + S128K + S160D | G118V + S128V + P129E + S130K + S166D |
| G116V + S126R + P127S + S128P | G118V + S128R + P129S + S130P |
| S126R + P127Q + S128D | S126R + P129Q + S130D |
| S126C + P127R + S128D | S128LC + P129R + S130D |
| S126C + P127R + S128G | S128LC + P129R + S130G |

Amino Acid Identity

The relatedness between two amino acid sequences is described by the parameter "identity". For purposes of the present invention, the alignment of two amino acid sequences is determined by using the Needle program from the EMBOSS package (http://emboss.org) version 2.8.0. The Needle program implements the global alignment algorithm described in Needleman, S. B. and Wunsch, C. D. (1970) J. Mol. Biol. 48, 443-453. The substitution matrix used is BLOSUM62, gap opening penalty is 10, and gap extension penalty is 0.5.

The degree of identity between an amino acid sequence of and enzyme used herein ("invention sequence") and a different amino acid sequence ("foreign sequence") is calculated as the number of exact matches in an alignment of the two sequences, divided by the length of the "invention sequence" or the length of the "foreign sequence", whichever is the shortest. The result is expressed in percent identity. An exact match occurs when the "invention sequence" and the "foreign sequence" have identical amino acid residues in the same positions of the overlap. The length of a sequence is the number of amino acid residues in the sequence.

Amylase

Amylases for use herein, including chemically or genetically modified mutants (variants), are alkaline amylases possessing at least 90%, preferably 95%, more preferably 98%, even more preferably 99% and especially 100% identity, with those derived from *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred low temperature amylases include:

(a) the variants described in U.S. Pat. No. 5,856,164 and WO99/23211, WO 96/23873, WO00/60060 and WO 06/002643, especially the variants with one or more substitutions in the following positions versus SEQ ID No: 2 of EP 2 100 949: 9, 26, 30, 33, 82, 37, 106, 118, 128, 133, 149, 150, 160, 178, 182, 186, 193, 195, 202, 203, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484 that also preferably contain the deletions of D183* and G184*.

(b) variants exhibiting at least 90% identity with the wild-type enzyme from *Bacillus* SP722 (SEQ ID No. 4 in WO06/002643, p. 7-9 of sequence listings), especially variants with deletions in the 183 and 184 positions and variants described in WO 00/60060, which is incorporated herein by reference.

(c) variants exhibiting at least 95% identity with SEQ ID NO:4 of EP 2 100 949, the wild-type enzyme from *Bacillus* sp.707, especially those comprising one or more of the following mutations M202, M208, S255, R172, and/or M261. Preferably said amylase comprises one or more of M202L, M202V, M2025, M202T, M2021, M202Q, M202W, S255N and/or R172Q. Particularly preferred are those comprising the M202L or M202T mutations.

Preferred commercially available amylases for use herein are TERMAMYL®, DURAMYL®, STAINZYME®, STAINZYME PLUS®, STAINZYME ULTRA® and NATALASE® (Novozymes A/S) and POWERASE® (DuPont).

Protease

The variant protease for use herein is a protease with variations versus a protease that has at least 70%, preferably at least 90%, more preferably at least 95%, even more preferably at least 99% and especially 100% identity with the amino acid sequence of SEQ ID NO:1 from EP 2 100 949 Said variant protease comprises substitutions in one or more of the following positions: 9, 15, 32, 33, 48-54, 58-62, 66, 68, 94-107, 116, 123-133, 150, 152-156, 158-161, 164, 169, 175-186, 197, 198, 203-216, 239 as compared with the protease in SEQ ID NO:1 from EP 2 100 949 (i.e. the amino acids at the specified position, not the BPN' numbering scheme). Preferably, said protease has substitutions in one or more of the following positions: 60, 74, 85, 94, 97-102, 105, 116, 123-128, 150, 152, 160, 183, 203, 211, 212, 213, 214, 216 and 239. More preferably, the protease comprises mutations in one or more, even more preferably in three or more of the following positions, 9, 15, 74, 85, 99, 116, 126, 127, 128, 160, 212 and 239.

Especially preferred are variants with mutations in each of positions 116, 126, 127 and 128.

Particularly suitable for use in the composition of the invention has been found to be a protease comprising the following specific mutations versus the enzyme of SEQ ID NO:1 from EP 2 100 949

(i) G116V+S126L+P127Q+S128A
(ii) G116V+S126N+P127S+S128A+S160D
(iii) G116V+S126L+P127Q+S128A+S160D
(iv) G116V+S126V+P127E+S128K
(v) G116V+S126V+P127M+S160D
(vi) S128T
(vii) G116V+S126F+P127L+S128T
(viii) G116V+S126L+P127N+S128V
(ix) G116V+S126F+P127Q
(x) G116V+S126V+P127E+S128K+S160D
(xi) G116V+S126R+P127S+S128P
(xii) S126R+P127Q+S128D
(xiii) S126C+P127R+S128D; or
(xiv) S126C+P127R+S128G
(xv) S99G+V102N (xvi) N74D+N85S+S101A+V102I
(xvii) V66A+N85S+S99G+V102N
(xviii) S9R+A15T+V66A+Q239R
(xix) S9R+A15T+G59E+V66A+A96S+S97G+Q239R;
(xx) S9R+A15T+V66A+N212D+Q239R
(xxi) S9R+A15T+V68A+N212D+Q239R Especially preferred for use in the composition of the invention has been found to be a protease comprising the mutations G116V+S126L+P127Q and S128A.

Preferred commercially available protease enzymes include those sold under the trade names Alcalase®, Savinase®, Primase®, Durazym®, Polarzyme®, Kannase®, Liquanase®, Ovozyme®, Neutrase®, Everlase®, Blaze® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase®, Ultimase® and Purafect OXP® by Genencor International, and those sold under the tradename Opticlean® and Optimase® by Solvay Enzymes.

Unit Dose Form

Preferably the composition of the invention is a unit-dose product. Products in unit dose form include tablets, capsules, sachets, pouches, injection moulded compartments, etc. Preferred for use herein are tablets and unit dose form wrapped with a water-soluble film (including wrapped tablets, capsules, sachets, pouches) and injection moulded containers. The unit dose form of the invention is preferably a water-soluble multi-compartment pack.

Preferred packs comprise at least two side-by-side compartments superposed (i.e., placed above) onto another compartment, especially preferred are pouches. This disposition contributes to the compactness, robustness and strength of the pack, additionally, it minimise the amount of water-soluble material required. It only requires three pieces of material to form three compartments. The robustness of the pack allows also for the use of very thin films without compromising the physical integrity of the pack. The pack is also very easy to use because the compartments do not need to be folded to be used in machine dispensers of fix geometry. At least two of the compartments of the pack contain two different compositions. By "different compositions" herein is meant compositions that differ in at least one ingredient.

Preferably, at least one of the compartments contains a solid composition, preferably in powder form and another compartment a liquid composition, the compositions are preferably in a solid to liquid weight ratio of from about 20:1 to about 1:20, more preferably from about 18:1 to about 2:1 and even more preferably from about 15:1 to about 5:1. This kind of pack is very versatile because it can accommodate compositions having a broad spectrum of values of solid: liquid ratio. Particularly preferred have been found to be pouches having a high solid:liquid ratio because many of the detergent ingredients are most suitable for use in solid form, preferably in powder form. The ratio solid:liquid defined herein refers to the relationship between the weight of all the solid compositions and the weight of all the liquid compositions in the pack.

Preferably solid:liquid weight ratio is from about 2:1 to about 18:1, more preferably from about 5:1 to about 15:1. These weight ratios are suitable in cases in which most of the ingredients of the detergent are in liquid form.

Preferably the two side-by-side compartments contain liquid compositions, which can be the same but preferably are different and another compartment contains a solid composition, preferably in powder form, more preferably a densified powder. The solid composition contributes to the strength and robustness of the pack.

For dispenser fit reasons, especially in an automatic dishwasher, the unit dose form products herein have a square or rectangular base and a height of from about 1 to about 5 cm, more preferably from about 1 to about 4 cm. Preferably the weight of the solid composition is from about 5 to about 20 grams, more preferably from about 10 to about 15 grams and the weight of the liquid compositions is from about 0.5 to about 4 grams, more preferably from about 0.8 to about 3 grams.

In preferred embodiments, at least two of the films which form different compartments have different solubility, under the same conditions, releasing the content of the compositions which they partially or totally envelope at different times.

Controlled release of the ingredients of a multi-compartment pouch can be achieved by modifying the thickness of the film and/or the solubility of the film material. The solubility of the film material can be delayed by for example cross-linking the film as described in WO 02/102,955 at pages 17 and 18. Other water-soluble films designed for rinse release are described in U.S. Pat. No. 4,765,916 and U.S. Pat. No. 4,972,017. Waxy coating (see WO 95/29982) of films can help with rinse release. pH controlled release means are described in WO 04/111178, in particular amino-acetylated polysaccharide having selective degree of acetylation.

Other means of obtaining delayed release by multi-compartment pouches with different compartments, where the compartments are made of films having different solubility are taught in WO 02/08380.

EXAMPLES

Examples 1

The removal of baked-on and burnt-on soil in a dishwasher using three different detergent compositions was evaluated. The first composition (Composition A) represents a typical auto dishwashing detergent composition. The second composition (Composition B) further comprises an anionic surfactant (LAS). The third composition (Composition C), within the scope of the invention, in addition to the anionic surfactant (LAS) comprises a cyclic amine (methylcyclohexane-1,3-diamine). As it can be seen from the results below (Table 1), the composition according to the invention provides considerably greater burnt-on, baked-on soil removal than the compositions outside the scope of the invention.

The auto dishwashing detergent compositions showed in Table 1, expressed in g of active material added per wash, were used to assess baked-on, burnt-on soil removal from a stainless steel slide in a dishwasher.

TABLE 1

| Ingredients | Composition A | Composition B | Composition C |
|---|---|---|---|
| Sodium Carbonate | 7.11 | 7.11 | 7.11 |
| LAS (alkyl benzene sulphonate) | — | 4.00 | 4.00 |
| Sodium Sulfate | 2.80 | 2.80 | 2.80 |
| MGDA | 2.20 | 2.20 | 2.20 |
| Methylcyclohexane-1,3-diamine | — | — | 2.20 |
| Sulphonated polymer | 2.00 | 2.00 | 2.00 |

TABLE 1-continued

| Ingredients | Composition A | Composition B | Composition C |
|---|---|---|---|
| Sodium Percarbonate | 1.41 | 1.41 | 1.41 |
| Nonionic surfactant | 1.23 | 1.23 | 1.23 |
| TAED | 0.32 | 0.32 | 0.32 |
| Suds suppressor | — | 0.25 | 0.25 |
| HEDP | 0.10 | 0.10 | 0.10 |
| BTA | 0.01 | 0.01 | 0.01 |
| Protease | 0.010 | 0.010 | 0.010 |
| Amylase | 0.003 | 0.003 | 0.003 |
| Bleach catalyst | 0.003 | 0.003 | 0.003 |
| Miscellaneous | 1.45 | 1.45 | 1.45 |
| Cleaning index vs. Composition A | 100 | 192 | 280 |
| Delta SRI vs. Composition A | — | +24.1 | +47.1 |

Example 2

In a separate test, the removal of baked-on, burnt-on soil in a dishwasher using three different detergent compositions was evaluated. The first composition (Composition A) represents a typical auto dishwashing detergent composition. The second composition (Composition D) further comprises an anionic surfactant (LAS). The third composition (Composition E), within the scope of the invention, in addition to the anionic surfactant (LAS) comprises a polyetheramine (BEPPA 4). As it can be seen from the results below (Table 2), the composition according to the invention provides considerably greater burnt-on, baked-on soil removal than the compositions outside the scope of the invention.

The auto dishwashing detergent compositions showed in Table 2, expressed in g of active material added per wash, were used to assess baked-on, burnt-on soil removal from a stainless steel slide in a dishwasher.

TABLE 2

| Ingredients | Composition A | Composition B | Composition E |
|---|---|---|---|
| Sodium Carbonate | 7.11 | 7.11 | 7.11 |
| LAS | — | 4.40 | 4.40 |
| Sodium Sulfate | 2.80 | 2.80 | 2.80 |
| MGDA | 2.20 | 2.20 | 2.20 |
| BEPPA 4 | — | — | 2.20 |
| Sulphonated polymer | 2.00 | 2.00 | 2.00 |
| Sodium Percarbonate | 1.41 | 1.41 | 1.41 |
| Nonionic surfactant | 1.23 | 1.23 | 1.23 |
| TAED | 0.32 | 0.32 | 0.32 |
| Suds suppressor | — | 0.25 | 0.25 |
| HEDP | 0.10 | 0.10 | 0.10 |
| BTA | 0.01 | 0.01 | 0.01 |
| Protease | 0.010 | 0.010 | 0.010 |
| Amylase | 0.003 | 0.003 | 0.003 |
| Bleach catalyst | 0.003 | 0.003 | 0.003 |
| Miscellaneous | 1.45 | 1.45 | 1.45 |
| Cleaning index vs. Composition A | 100 | 113 | 155 |

TABLE 2-continued

| Ingredients | Composition A | Composition B | Composition E |
|---|---|---|---|
| Delta SRI vs. Composition A | — | +5.15 | +22.38 |

The polyetheramine tested was:

BEEPA 4: 2-Butyl-2-Ethyl-1,3-Propanediol Propoxylated Aminated where n+m=4 on average.

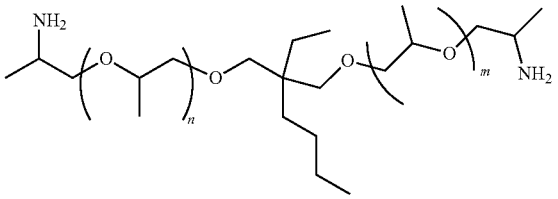

Synthesis of 1 mol of 2-Butyl-2-ethyl-1,3-propane diol+4 mol propylene oxide, aminated a) 1 mol 2-Butyl-2-ethyl-1,3-propane diol+4 mol propylene oxide In a 2 l autoclave 322.6 g 2-Butyl-2-ethyl-1,3-propane diol and 7.9 g KOH (50% in water) were mixed and stirred under vacuum (<10 mbar) at 120° C. for 2 h. The autoclave was purged with nitrogen and heated to 140° C. 467.8 g propylene oxide was added in portions within 6 h. To complete the reaction, the mixture was allowed to post-react for additional 5 h at 140° C. The reaction mixture was stripped with nitrogen and volatile compounds were removed in vacuo at 80° C. The catalyst potassium hydroxide was removed by adding 2.3 g synthetic magnesium silicate (Macrosorb MP5plus, Ineos Silicas Ltd.), stirring at 100° C. for 2 h and filtration. A yellowish oil was obtained (772.0 g, hydroxy value: 248.5 mgKOH/g).

b) 1 mol 2-Butyl-2-ethyl-1,3-propane diol+4 mol propylene oxide, aminated

In a 91 autoclave 600 g of the resulting diol mixture from step a), 1250 g THF and 1500 g ammonia were mixed in presence of 200 ml of a solid catalyst as described in EP0696572B1.

The catalyst containing nickel, cobalt, copper, molybdenum and zirconium was in the form of 3×3 mm tables. The autoclave was purged with hydrogen and the reaction was started by heating the autoclave. The reaction mixture was stirred for 18 h at 205° C., 5 the total pressure was maintained at 270 bar by purging hydrogen during the entire reductive amination step. After cooling down the autoclave the final product was collected, filtered, vented of excess ammonia and stripped in a rotary evaporator to remove light amines and water. A total of 560 grams of a low-color etheramine mixture was recovered. The analytical results thereof are shown in the table below:

| Total amine-value mg KOH/g | Total acetylatables mg KOH/g | Secondary and tertiary amine value mg KOH/g | Tertiary amine-value mg KOH/g | Hydroxyl value mg KOH/g | Degree of amination in % | Primary Amine in % of total amine |
|---|---|---|---|---|---|---|
| 277.66 | 282.50 | 4.54 | 0.86 | 5.70 | 98.59 | 98.36 |

Methodology:

Stainless Steel Slide Preparation

To prepare the baked-on, burnt-on soil 6 g of corn oil, 6 g of peanut oil and 6 g of sunflower oil were added into a glass beaker and continually stirred. While stirring, 2.5 g of powdered albumin were added gradually. This mixture was allowed to stir for 1 hour.

Each clean stainless steel slide was identified and its individual weight recorded. Then the soil was applied onto the slide, using a mini sponge roller to cover it across its length, leaving about 1-2 cm from the top of the slide clean. The amount of soil added to each slide was about 0.065 g (±0.0025 g).

Once soil was applied, the soiled slides were laid on a metal baking tray and placed in a preheated oven at 160° C. and baked for 2 hours. After this time elapsed the slides were removed from the oven and allowed to cool down and finally the post-baked weight of all slides were taken and recorded.

Six slides were placed in the bottom rack of a Miele 1022 dishwasher, three on each side of the dishwasher, clipping them into the rack prongs when necessary. The selected wash temperature was 50° C. using city water with water hardness of 8 USgpg. Each composition was run at least twice and no additional soil was added into the wash. At the end of the wash the slides were allowed to dry overnight and then weighed. Results are expressed gravimetrically as a % of soil removed from known weight of soil on slide, taking composition A as reference.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An automatic dishwashing detergent composition comprising:

a) from about 0.1% to about 20% by weight of a cleaning surfactant selected from the group consisting of an anionic surfactant, a zwitterionic surfactant, an amphoteric surfactant, and mixtures thereof;

b) from about 0.1% to about 20% by weight of a cleaning amine, wherein the amine is a polyetheramine selected from the group consisting of polyetheramines of Formula (I), Formula (II), Formula (III) and a mixture thereof:

Formula (I)

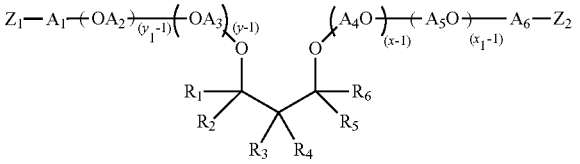

Formula (II)

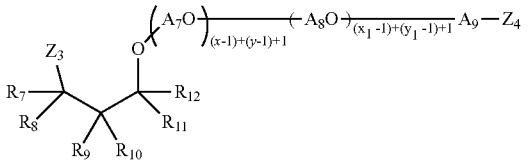

wherein each of $R_1$-$R_{12}$ is independently selected from H, alkyl, cycloalkyl, aryl, alkylaryl, or arylalkyl, wherein at least one of $R_1$-$R_6$ and at least one of $R_7$-$R_{12}$ is different from H, each of $A_1$-$A_9$ is independently selected from linear or branched alkylenes having about 2 to about 18 carbon atoms, each of $Z_1$-$Z_4$ is independently selected from OH or $NH_2$, wherein at least one of $Z_1$-$Z_2$ and at least one of $Z_3$—$Z_4$ is $NH_2$, wherein the sum of x+y is in the range of about 2 to about 200, wherein x≥1 and y≥1, and the sum of $x_1+y_1$ is in the range of about 2 to about 200, wherein $x_1 \geq 1$ and $y_1 \geq 1$ Formula (III)

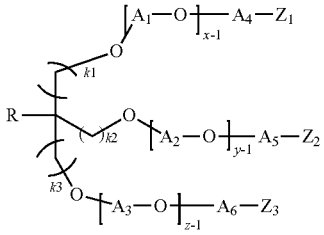

wherein R is selected from H or a C1-C6 alkyl group, each of $k_1$, $k_2$, and $k_3$ is independently selected from 0, 1, 2, 3, 4, 5, or 6, each of $A_1$, $A_2$, $A_3$, $A_4$, $A_5$, and $A_6$ is independently selected from a linear or branched alkylene group having from about 2 to about 18 carbon atoms or mixtures thereof, x≥1, y≥1, and z≥1, and the sum of x+y+z is in the range of from about 3 to about 100, each of $Z_1$, $Z_2$, and $Z_3$ is independently selected from $NH_2$ or OH, where at least two of $Z_1$, $Z_2$, and $Z_3$ are $NH_2$; and the polyetheramine has a weight average molecular weight of from about 150 to about 1000 grams/mole.

2. A composition according to claim 1, wherein said cleaning surfactant comprises an anionic surfactant selected from the group consisting of sulfonate, sulfate, carboxylate and mixtures thereof.

3. A composition according to claim 1 wherein in said polyetheramine of Formula (I) or Formula (II), each of $A_1$-$A_9$ is independently selected from ethylene, propylene, or butylene.

4. A composition according to claim 1 wherein the polyetheramine of Formula (I) has the following formula:

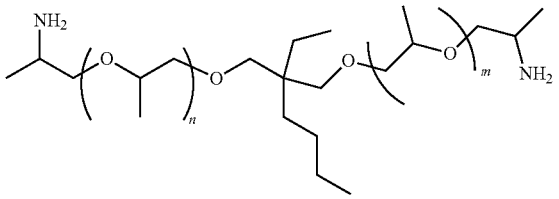

wherein n+m is from about 0 to about 8.

5. A composition according to claim 1 further comprising an aminocarboxylic builder.

6. A composition according to claim 1 wherein the composition is free of non-ionic surfactant.

7. A composition according to claim 1 further comprising a suds suppressor.

8. A composition according to claim 1 further comprising alkaline amylases possessing at least about 90% identity, with those derived from *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1 022 334).

9. A composition according to claim 1 further comprising a protease with variations versus a protease that has at least about 70% identity with the amino acid sequence of SEQ ID NO:1 from EP 2 100 949 said variant protease comprises substitutions in one or more of the following positions: 9, 15, 32, 33, 48-54, 58-62, 66, 68, 94-107, 116, 123-133, 150, 152-156, 158-161, 164, 169, 175-186, 197, 198, 203-216, 239 as compared with the protease in SEQ ID NO:1 (i.e. the amino acids at the specified position, not the BPN' numbering scheme).

10. A method of removing cooked-on, baked-on and burnt-on soils from cookware/tableware by subjecting the cookware/tableware to a composition according to claim 1 in an automatic dishwashing machine.

* * * * *